US008613322B2

(12) United States Patent
Coles

(10) Patent No.: US 8,613,322 B2
(45) Date of Patent: Dec. 24, 2013

(54) METHOD FOR MOTION COMPENSATION DURING ACTIVE INTERVENTION OPERATIONS

(76) Inventor: Robert A. Coles, Lafayette, LA (US)

( * ) Notice: Subject to any disclaimer, the term of this patent is extended or adjusted under 35 U.S.C. 154(b) by 0 days.

(21) Appl. No.: 13/487,589

(22) Filed: Jun. 4, 2012

(65) Prior Publication Data

US 2012/0241164 A1 Sep. 27, 2012

Related U.S. Application Data

(63) Continuation of application No. 12/804,048, filed on Jul. 13, 2010, now Pat. No. 8,191,636.

(60) Provisional application No. 61/270,764, filed on Jul. 13, 2009.

(51) Int. Cl.
*E21B 19/09* (2006.01)

(52) U.S. Cl.
USPC ..... 166/355; 166/250.01; 166/77.1; 405/224.2

(58) Field of Classification Search
USPC ..... 166/355, 339, 344, 351, 352, 367, 381, 166/250.01, 77.1, 77.2, 75.14; 405/195.1, 405/196, 224, 224.2–224.4
See application file for complete search history.

(56) References Cited

U.S. PATENT DOCUMENTS

RE27,261 E * 12/1971 Bromell ..... 114/264
3,785,445 A * 1/1974 Scozzafava ..... 175/5
3,834,672 A * 9/1974 Hawley et al. ..... 254/392
4,176,722 A * 12/1979 Wetmore et al. ..... 175/7
4,694,909 A * 9/1987 Stephenson et al. ..... 166/356
6,000,480 A * 12/1999 Eik ..... 175/8
6,343,893 B1 * 2/2002 Gleditsch ..... 405/196
6,470,969 B1 * 10/2002 Sørhaug et al. ..... 166/355
6,691,784 B1 * 2/2004 Wanvik ..... 166/355
6,708,765 B1 * 3/2004 Eilertsen ..... 166/350
6,752,213 B1 * 6/2004 van der Poel ..... 166/355
6,929,071 B2 * 8/2005 Moncus et al. ..... 166/355
7,163,061 B2 * 1/2007 Moncus et al. ..... 166/355
7,191,837 B2 * 3/2007 Coles ..... 166/355
7,219,739 B2 * 5/2007 Robichaux ..... 166/355
7,231,981 B2 * 6/2007 Moe et al. ..... 166/355
7,306,404 B2 * 12/2007 Torgersen ..... 405/224.4
7,314,087 B2 * 1/2008 Robichaux ..... 166/355
7,404,443 B2 * 7/2008 Patton et al. ..... 166/355
7,530,399 B2 * 5/2009 Dreelan ..... 166/355
7,784,546 B2 * 8/2010 Patton ..... 166/355
8,162,062 B1 * 4/2012 Barone et al. ..... 166/355
8,191,636 B2 * 6/2012 Coles ..... 166/355
2008/0099208 A1 * 5/2008 Moncus et al. ..... 166/338
2008/0251258 A1 * 10/2008 Bamford ..... 166/355

* cited by examiner

*Primary Examiner* — Matthew Buck
(74) *Attorney, Agent, or Firm* — Ted M. Anthony

(57) ABSTRACT

An Active Motion Compensation system for use during intervention or other work on subsea wells, pipelines or other structures. The present invention can be employed on existing floating production platforms such as Tension Leg Platforms (TLP) and Spar structures where intervention work including Coiled Tubing, Slickline, Electric Line, Wireline, as well as snubbing or Hydraulic Workover activities are being utilized. It can also be deployed over the side of or through the moon pool of a vessel without the need of any other compensation device.

4 Claims, 6 Drawing Sheets

METHOD FOR MOTION COMPENSATION DURING ACTIVE INTERVENTION OPERATIONS

CROSS REFERENCES TO RELATED APPLICATION

Priority of U.S. Non-Provisional patent application Ser. No. 12/804,048, filed Jul. 13, 2010, currently pending, which claims priority of U.S. Provisional Patent Application Ser. No. 61/270,764 filed Jul. 13, 2009, both incorporated herein by reference, is hereby claimed.

STATEMENTS AS TO THE RIGHTS TO THE INVENTION MADE UNDER FEDERALLY SPONSORED RESEARCH AND DEVELOPMENT

None

BACKGROUND OF THE INVENTION

1. Field of the Invention

The present invention pertains to a method and apparatus for supporting equipment used during intervention operations conducted from marine vessels and/or offshore installations. More particularly still, the present invention pertains to a method and apparatus for compensating for motion encountered during intervention operations conducted from marine vessels and/or offshore installations including, without limitation, operations utilizing coiled tubing, slickline, electric line, wireline, snubbing and/or hydraulic workover units.

2. Brief Description of the Prior Art

As the world's supply of readily accessible oil and gas reserves becomes depleted, significant oil and gas exploration and production operations have shifted to more challenging environments, including deep-water locations. Wells drilled on such locations are often situated in thousands of feet of water, which makes setting of conventional production platforms—that is, support structures permanently anchored to the sea floor—extremely difficult. In certain water depths, installation of conventional production platforms is not possible.

In such cases, wells are typically drilled from floating vessels such as semi-submersible drilling rigs, drill ships and the like. Further, such wells are generally completed using "subsea" completion equipment. In such cases, wellheads and related equipment are situated on the sea floor, while an extensive array of flow lines are used to connect such subsea wells to floating production facilities, pipeline interconnection points and/or other subsea completions.

It is often beneficial to concentrically convey wireline (including, without limitation, slickline, braided line or electric line) and associated tools within wellbores and/or pipelines in order to perform operations in such wells and pipelines. In some cases, hoses or flexible tubing can also be concentrically inserted within a well or pipeline, especially when it is desired to provide a flow path for circulating fluid within said well or pipeline, such as when washing out debris, or when operating fluid-actuated tools in the well or pipeline.

Although the different applications are too numerous to list, in most cases a length of wire or flexible continuous tubing extends from a storage reel or spool and passes through a sheave or gooseneck assembly. Such sheave or gooseneck assembly serves to redirect the wire or flexible continuous tubing into an opening of a wellbore or pipeline, while also reducing the frictional forces acting on said wireline or continuous tubing as it enters the well or pipeline.

Such operations generally do not require specialized equipment when they are performed from fixed platforms or other anchored structures. However, in the case of subsea wells and pipelines, the necessary equipment for performing such intervention operations must typically be mounted on a boat, semi submersible drilling rig or other floating vessel positioned on the surface of the water. In such cases, the boat, semi-submersible drilling rig or other floating vessel can move (pitch and/or roll) with the wave action of the sea, thereby creating slack in the wireline or continuous tubing string and making it difficult to perform such intervention operations on a (stationary) well or pipeline.

As a result, when such intervention operations are performed from boats, drill ships, semi-submersible drilling rigs and/or other floating vessels, it is generally beneficial to maintain substantially uniform tension on the wireline, flexible continuous tubing or other intervention equipment inserted into a well or pipeline. In order to maintain such substantially uniform tension, the distance between the well or pipeline and the intervention equipment should beneficially remain substantially constant.

Thus, there is a need for a dynamic motion compensator that can maintain a substantially constant distance between a well or pipeline, on the one hand, and intervention equipment, on the other hand. Such dynamic motion compensator should beneficially hold substantially consistent tension on wireline, continuous tubing or other intervention equipment conveyed from a floating vessel into a well or pipeline. The motion compensator should beneficially maintain a substantially constant distance between such pipeline or wellhead, and the intervention equipment situated on a boat, semi-submersible drilling rig or other floating vessel.

SUMMARY OF THE PRESENT INVENTION

In the preferred embodiment, the active compensation apparatus of the present invention comprises a stationary outer frame, an outer frame adapter, an inner compensating frame, a compensator frame adapter, a power unit and a monitoring and control system. The inner compensator frame is capable of dynamically stroking up or down relative to the outer frame depending on tidal movement and/or wave action, and acts to keep a substantially constant vertical distance between the inner compensator frame assembly and the entry point of a pipeline, subsea wellhead, or other subsea structure.

The outer frame can be used in connection with many different types of structures and vessels. Specifically, the motion compensation apparatus of the present invention is modular in design such that a single outer frame design can be used in conjunction with an outer frame adapter that can fit configurations of many different structures or vessels. The outer frame of the present invention bolts or pins in place to the outer frame adapter. The outer frame adapter is then bolted, pinned, welded or otherwise attached to the deck of a boat or other vessel upon which it is deployed.

The inner compensating frame also has an adapter assembly that enables it to be used with multiple different riser and/or equipment support systems. In the preferred embodiment, the inner compensating frame moves in a vertical axis only, and rides inside a roller guide system that is part of the outer frame. The inner compensating frame is supported by either hydraulic cylinders or cables depending on stroke length for the system. If hydraulic cylinders are used, the cylinders are attached to the bottom of the inner compensating frame and work in a compression mode. If cables are used, such cables attach to the top side of the inner compensating frame and work in a tension mode, but are linked by a system of pulleys to a single hydraulic cylinder, a series of hydraulic cylinders, or winch type drum assembly. All of the aforementioned components act to keep the inner compensating frame in a steady state of pre-determined tension controlled by the monitoring control system.

The monitoring control system comprises at least one sensor that beneficially measures inner compensating frame tension, speed and position. These measurements are communicated to at least one processor, which controls the amount, direction and pressure of hydraulic fluid supplied from the hydraulic power unit to the cylinder(s) or winch drum assembly in order to keep the system as close as possible to a state of static tension.

BRIEF DESCRIPTION OF THE DRAWINGS

The foregoing summary, as well as the following detailed description of the preferred embodiments, is better understood when read in conjunction with the appended drawings. For the purpose of illustrating the invention, the drawings show certain preferred embodiments. It is understood, however, that the invention is not limited to the specific methods and devices disclosed.

DETAILED DESCRIPTION OF A PREFERRED EMBODIMENT OF THE INVENTION

Figure 1:
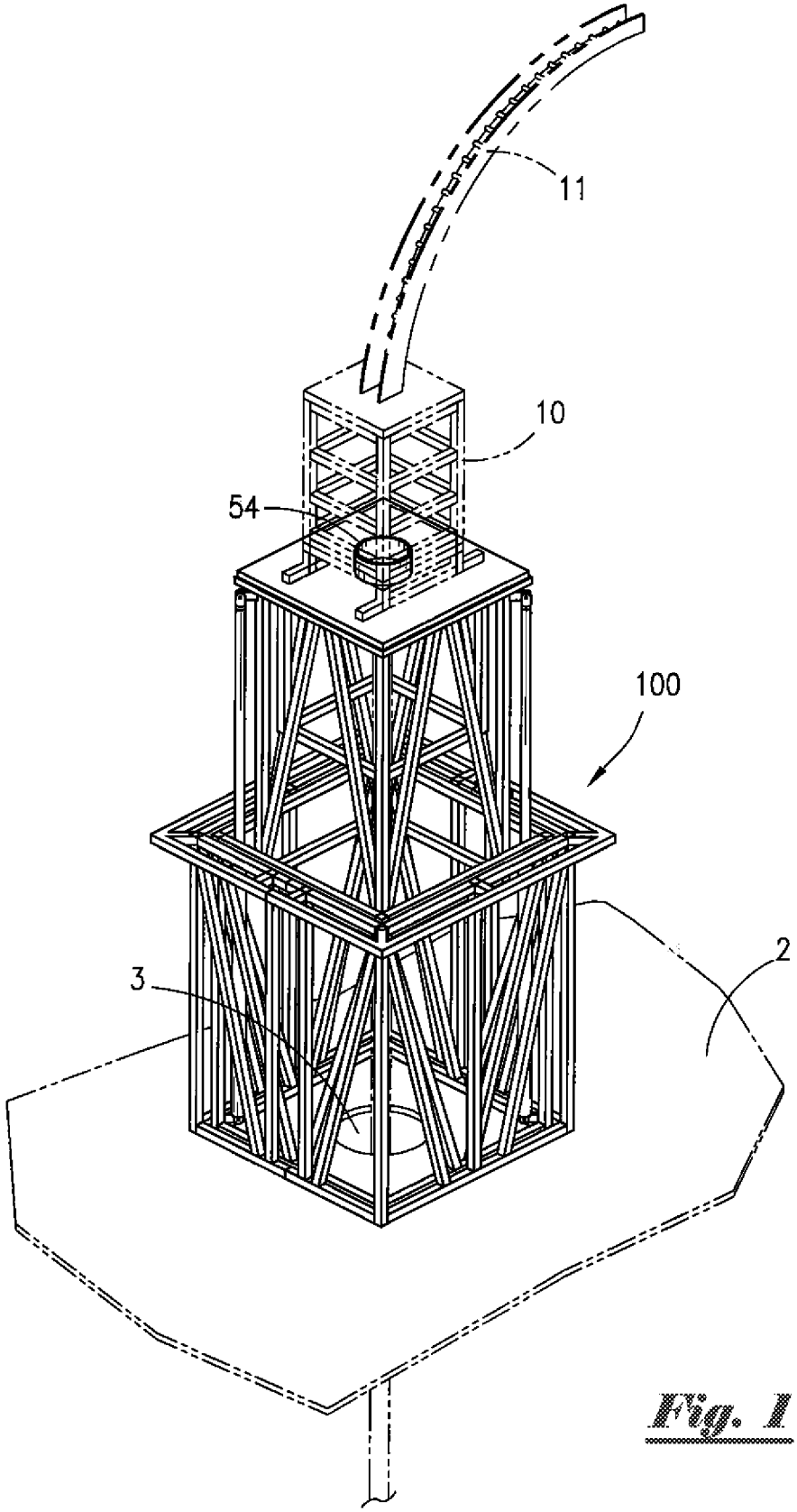
FIG. 1 depicts an overhead perspective view of the active motion compensation apparatus of the present invention.

FIG. 1 depicts an overhead perspective view of the active motion compensation apparatus 100 of the present invention. Said active motion compensation apparatus 100 can be beneficially mounted on any number of surfaces. In the preferred embodiment, active motion compensation apparatus 100 is disposed on substantially flat deck 2 of a boat, semi-submersible rig or other floating vessel.

Many different intervention technologies can be used in connection with active motion compensation apparatus 100 of the present invention. FIG. 1 depicts said apparatus 100 employed with a conventional coiled tubing unit of a type well known to those having skill in the art. Said conventional coiled tubing unit includes a length of flexible continuous tubing disposed on a reel or spool (not depicted in FIG. 1). The distal end of said flexible continuous tubing is unwound from said spool, threaded through curved goose neck assembly 11 and received within injector head assembly 10 (which is itself mounted on top of said active motion compensation apparatus 100). Said flexible continuous tubing extends through an opening in slip bowl 54 in active compensation apparatus 100, as well as opening 3 in vessel deck 2. Said opening 3 can be a moon pool of a drilling rig, or other opening extending though another type of vessel. Additionally, it is to be observed that active compensation apparatus 100 can also be mounted via support platform or cantilever assembly that extends and permits intervention activities over the side of a rig or other floating vessel.

Active motion compensation apparatus 100 of the present invention is described herein as being used in connection with a conventional coiled tubing apparatus. However, it is to be observed that said conventional coiled tubing apparatus is described for illustration purposes only, and that other intervention means or methods (including, without limitation, slickline, electric line, wireline, snubbing and/or hydraulic workover units, as well as other types of continuous tubing devices) can also be used in connection with the active motion compensation apparatus 100 of the present invention.

Figure 2:
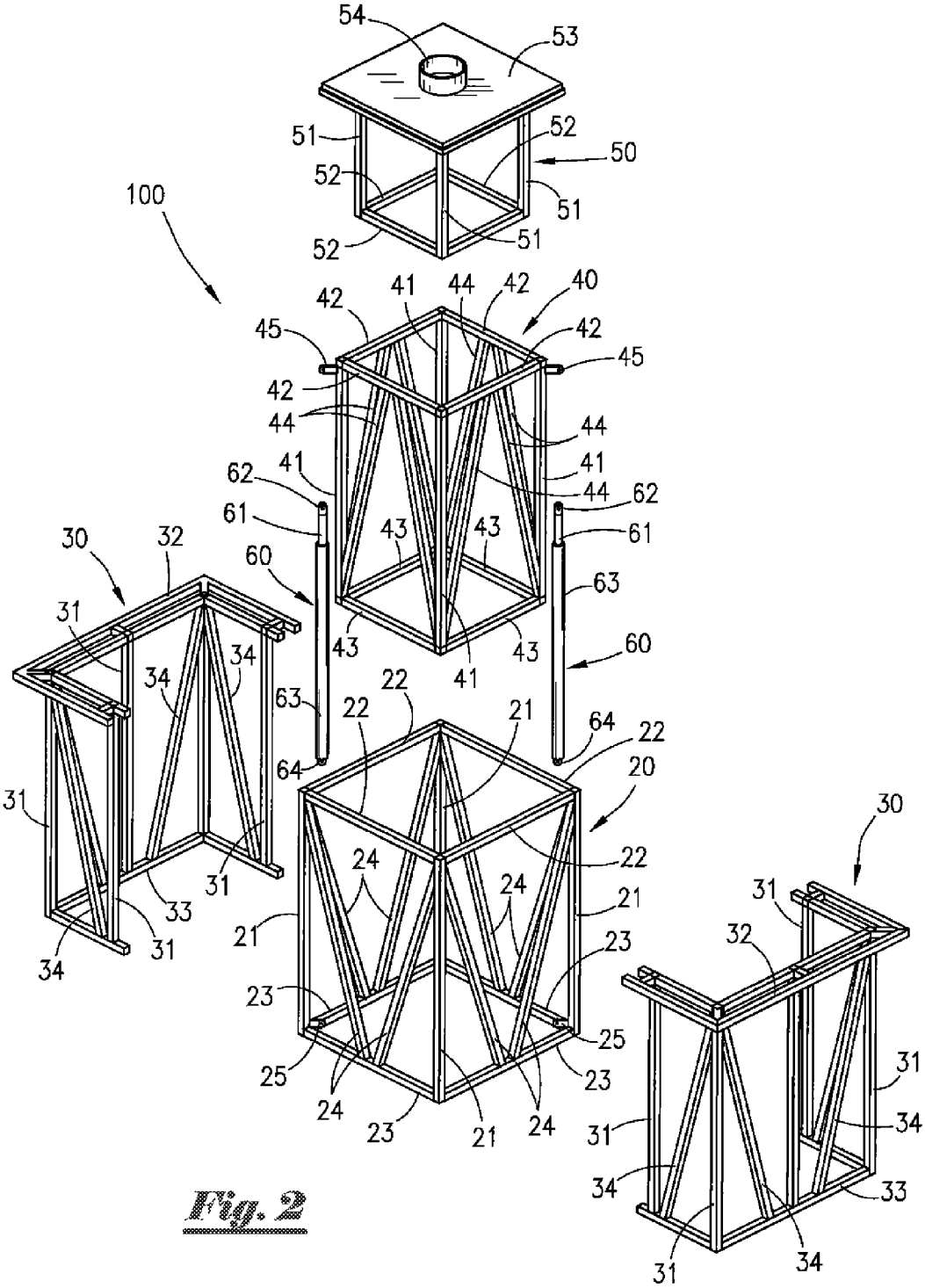
FIG. 2 depicts an exploded perspective view of the active motion compensation apparatus of the present invention.

FIG. 2 depicts an exploded perspective view of active motion compensation apparatus 100 of the present invention. In the preferred embodiment, active compensation apparatus 100 comprises stationary outer frame assembly 20, outer frame adapter assemblies 30, inner compensating frame assembly 40, upper support assembly 50, as well as a power unit and a monitoring and control system (not depicted in FIG. 2).

In the preferred embodiment, stationary outer frame assembly 20, outer frame adapter assemblies 30 and inner compensating frame assembly 40 are beneficially constructed of tubular steel members or other similar components joined together to form such assemblies. Specifically, stationary outer frame assembly 20 comprises vertical corner members 21, upper horizontal members 22, lower horizontal members 23 and frame support members 24, joined together to define cage-like stationary outer frame assembly 20 having a central void or opening.

Similarly, outer frame adapter assemblies 30 comprise vertical members 31 upper horizontal members 32, lower horizontal members 33 and frame support members 34, joined together to define said outer frame adapter assemblies 30. Said outer frame adapter assemblies 30 have dimensions that are beneficially larger than said stationary outer frame assembly 20, and can be combined around the exterior of said stationary outer from assembly 20.

Inner compensating frame assembly 40 is likewise beneficially constructed of vertical corner members 41, upper horizontal members 42, lower horizontal members 43 and frame support members 44, joined together to define said inner compensating frame assembly 40. In the preferred embodiment, said inner compensating frame assembly 40 is slidably received within the central opening of said outer frame assembly 20.

Upper support assembly 50 generally comprises vertical frame members 51, horizontal frame members 52, substantially planar support surface 53 and slip bowl 54 defining an opening that extends through substantially planar support surface 53. In the preferred embodiment, said upper support assembly 50 is partially received within inner compensating frame assembly 40.

Hydraulic cylinders 60 are disposed between outer frame assembly 20 and inner compensator frame assembly 40. Hydraulic cylinders 60 each generally comprise piston rod 61 having rod mounting attachment 62, as well cylinder barrel 63 having barrel mounting attachment 64. Upper mounting devises 45 are disposed on inner compensator frame assembly 40 for connection to rod mounting attachments 62, while lower mounting clevises 25 are disposed on outer frame assembly 20 for connection to barrel mounting attachments 64.

Further, the apparatus of the present invention can be used in connection with many different types of structures and vessels. Specifically, active motion compensation apparatus 100 of the present invention is modular in design such that a single outer frame assembly 20 can be used in conjunction with many different styles or configurations of outer frame adapter assembly 30. Such outer frame adapter assembly 30 can be specifically configured or customized to fit a particular structure or vessel. Outer frame assembly 20 of the present invention can bolt or pin in place to said outer frame adapter assembly 30 which, in turn, can then be bolted, pinned, welded or otherwise attached to the deck of a boat or other vessel upon which active motion compensation apparatus 100 of the present invention is deployed.

Figure 3:
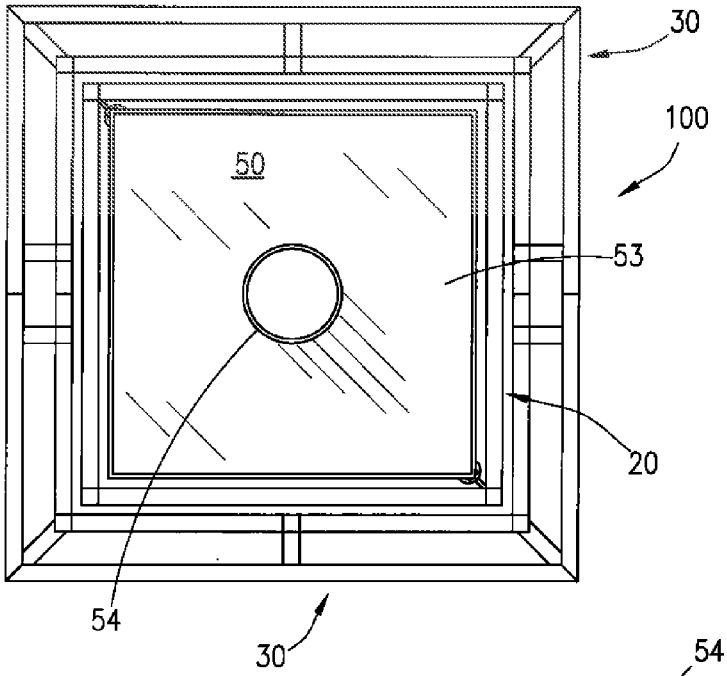
FIG. 3 depicts an overhead view of the active motion compensation apparatus of the present invention.

FIG. 3 depicts an overhead view of active motion compensation apparatus 100 of the present invention. Mating outer frame adapter assemblies 30 are joined together around outer frame assembly 20. Upper support assembly 50 having substantially planar support surface 53 and slip bowl 54 is partially received within inner compensating frame assembly 40 (not visible in FIG. 3), which is itself disposed within said outer frame assembly 20. Slip bowl 54 forms an opening which extends through said planar support surface 53.

Figure 4:
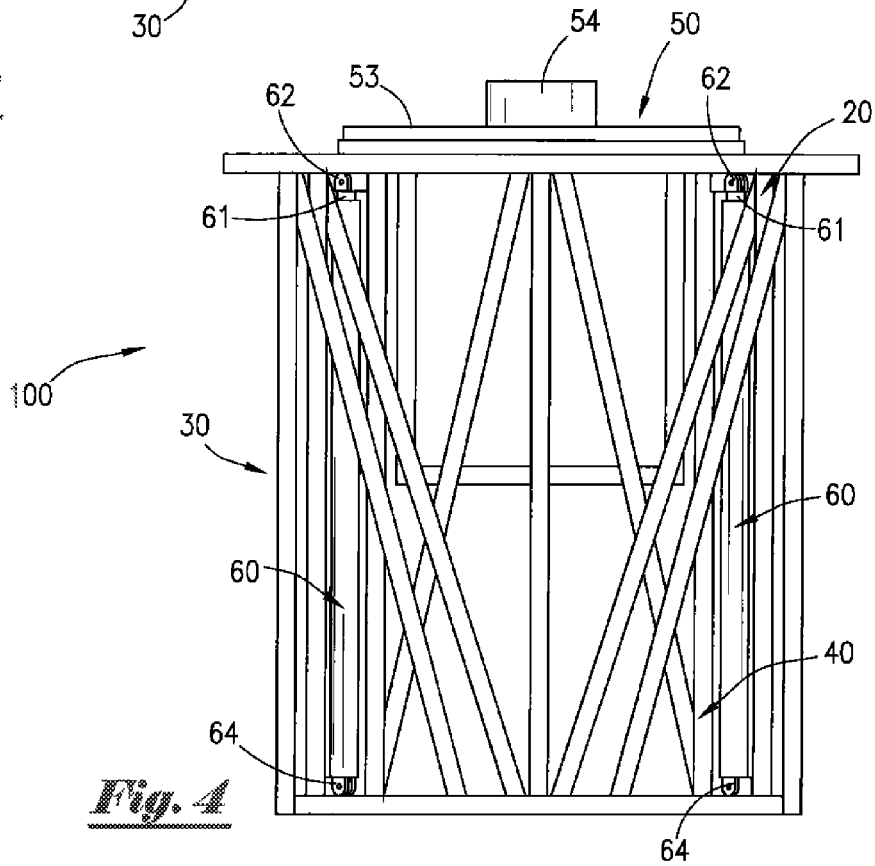
FIG. 4 depicts a side view of the active motion compensation apparatus of the present invention in a retracted position.

FIG. 4 depicts a side view of active motion compensation apparatus 100 of the present invention in a substantially retracted position. Outer frame adapter assemblies 30 fit together around outer frame assembly 20, and secure such outer frame assembly 20 in place. Upper support assembly 50 having substantially planar support surface 53 and slip bowl 54 is partially received within inner compensating frame assembly 40, which is itself disposed within said outer frame assembly 20.

Still referring to FIG. 4, hydraulic cylinders 60 are disposed between outer frame assembly 20 and inner compensator frame assembly 40. Hydraulic cylinders 60 each have piston rod 61 (not visible in FIG. 4) having rod mounting attachment 62, as well cylinder barrel 63 having barrel mounting attachment 64. In the preferred embodiment, rod mounting attachments 62 are connected to inner compensating frame assembly 40, while barrel mounting attachments 64 are connected to outer frame assembly 20.

Figure 5:
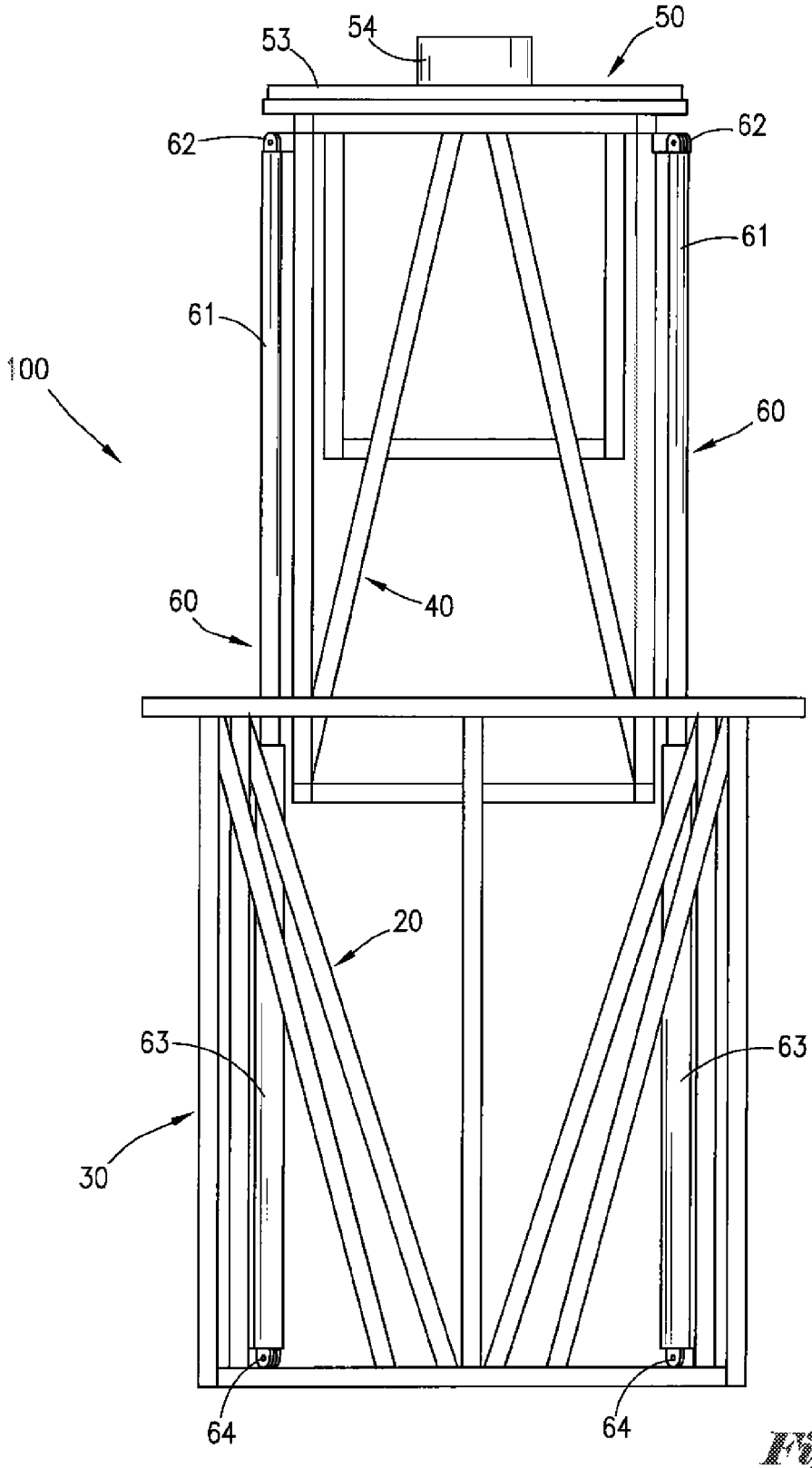
FIG. 5 depicts a side view of the active motion compensation apparatus of the present invention in an extended position.

FIG. 5 depicts a side view of the active motion compensation apparatus 100 of the present invention in an extended position. Mating outer frame adapter assemblies 30 fit together around outer frame assembly 20, and secure such outer frame assembly 20 in place. Upper support assembly 50 having substantially planar support surface 53 and slip bowl 54 is partially received within inner compensating frame assembly 40, which is itself movably disposed within said outer frame assembly 20. Hydraulic cylinders 60 are disposed between outer frame assembly 20 and inner compensator frame assembly 40. Hydraulic cylinders 60 each have piston rod 61 having rod mounting attachment 62, as well cylinder barrel 63 having barrel mounting attachment 64. In the preferred embodiment, rod mounting attachments 62 are connected to inner compensating frame assembly 40, while barrel mounting attachments 64 are connected to outer frame assembly 20. As depicted in FIG. 5, piston rods 61 are extending from cylinder barrels 63, causing inner compensating frame 40 to extend upward relative to outer frame assembly 20.

Figure 6:
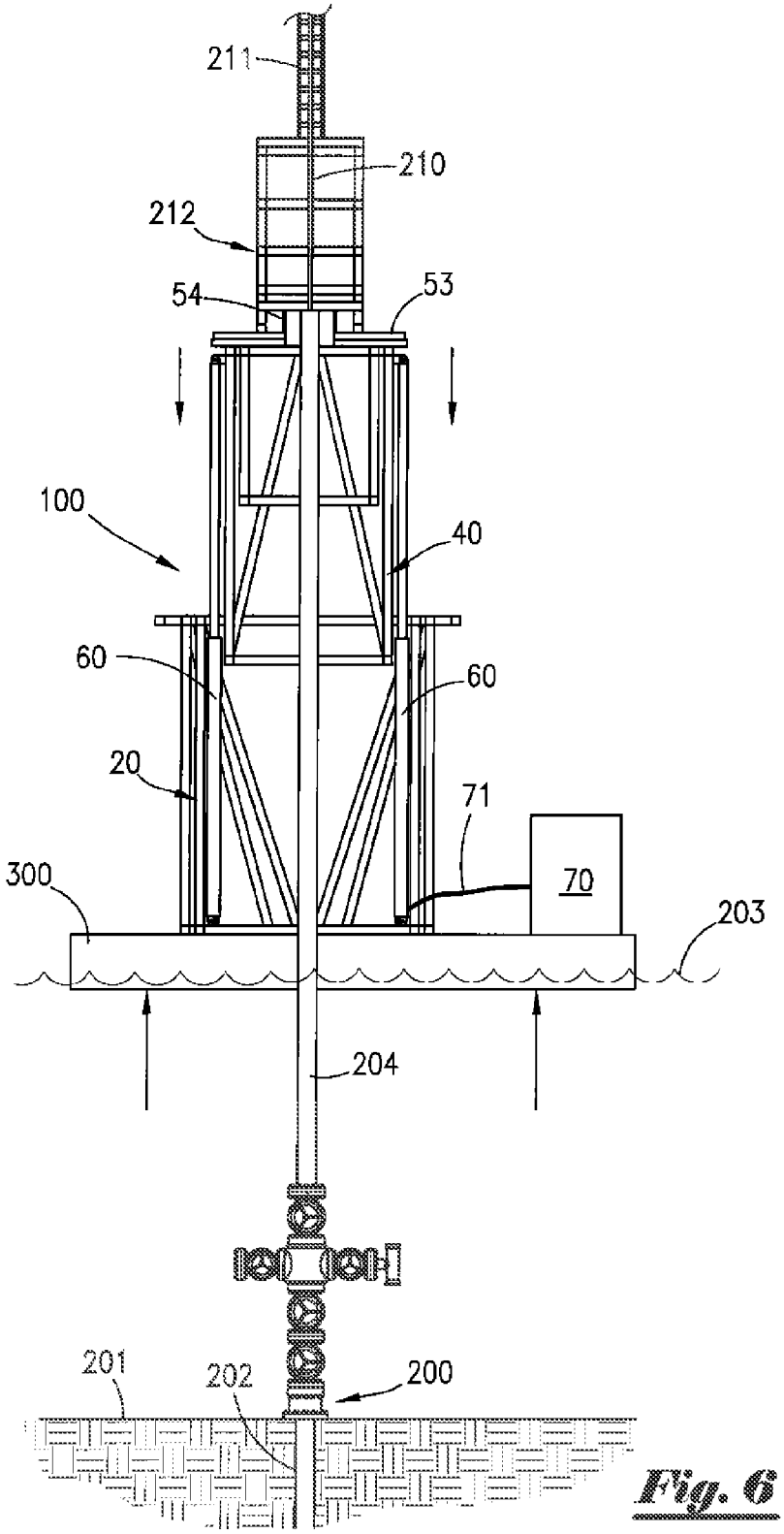
FIG. 6 depicts a side view of the active motion compensation apparatus of the present invention utilized to perform intervention work on a subsea installation using a vessel.

FIG. 6 depicts a side view of the active motion compensation apparatus 100 of the present invention utilized to perform intervention work on a subsea installation, such as subsea wellhead 200. Subsea wellhead 200 is disposed on sea floor 201, while well 202 extends into the earth's crust. Vessel 300 floats on the surface of water 203, which exerts upward buoyancy forces on said vessel 300. Riser 204 extends from subsea wellhead 200 through a hole in vessel 300 (representing a moon pool or other opening) to slip bowl 54 of the present invention. Said riser 204 provides a conduit that extends from active motion compensation apparatus 100 of the present invention to subsea wellhead 200.

A length of flexible continuous tubing 210 disposed on a reel or spool (not depicted in FIG. 6) is partially unwound from said spool, threaded through curved goose neck assembly 211 and inserted through injector head assembly 212 mounted on substantially planar support surface 53. Flexible continuous tubing 210 extends through slip bowl 54, and is concentrically received within riser 204, subsea wellhead 200 and well 202. Said flexible continuous tubing 210 can be reciprocated within well 202, or otherwise beneficially used to perform work within such well 202. Further, in many cases, fluids can be circulated in said well 202 via such continuous tubing 210.

In the preferred embodiment, monitoring control system 70 comprises a plurality of electronic sensors that measure inner compensating frame assembly tension, speed, position, as well as other relevant parameters. Data obtained from such sensors are supplied to at least one processor that controls the amount, direction and pressure of hydraulic fluid supplied from a hydraulic power unit (depicted as included within monitoring control assembly 70 in FIG. 6) to hydraulic cylinder(s) 60 (or winch drum or other lifting assembly) via hydraulic supply line 71 in order to adjust the position of inner compensating frame 40 relative to outer frame assembly 20, and to keep coiled tubing 210 substantially in a state of static tension.

Figure 7B:
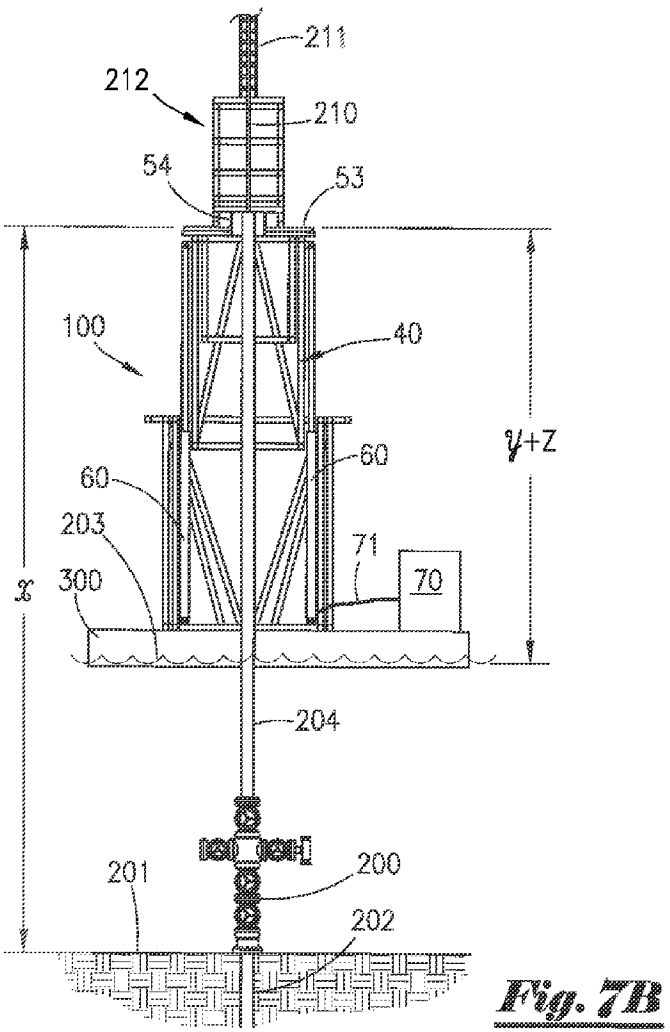
FIG. 7B depicts a side view of the active motion compensation apparatus of the present invention utilized to perform intervention work on a subsea well from a vessel in a second position.
Figure 7A:
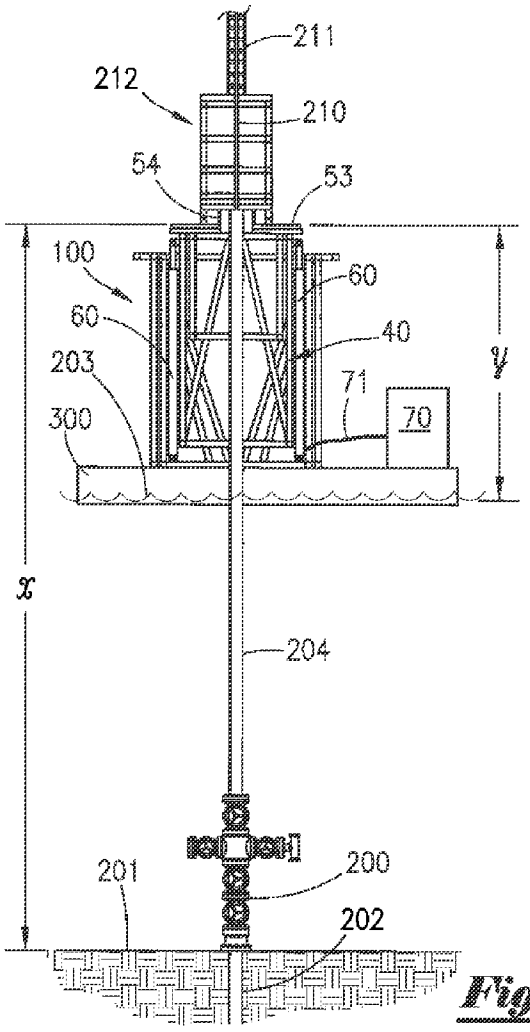
FIG. 7A depicts a side view of the active motion compensation apparatus of the present invention utilized to perform intervention work on a subsea well from a vessel in a first position.

FIG. 7A depicts a side view of the active motion compensation apparatus 100 of the present invention utilized to perform intervention work on a subsea well from a vessel in a first position, while FIG. 7B depicts a side view of the active motion compensation apparatus of the present invention utilized to perform intervention work on a subsea well from a vessel in a second position. Subsea wellhead 200 is disposed on sea floor 201, while well 202 extends into the earth's crust. Vessel 300 floats on the surface of water 203, which exerts upward buoyancy forces on said vessel 300. Riser 204 extends from subsea wellhead 200 through a hole in vessel 300 (representing a moon pool or other opening) to slip bowl 54 of the present invention, and provides a conduit that extends from active motion compensation apparatus 100 of the present invention to subsea wellhead 200.

A length of flexible continuous tubing 210 is partially unwound from a reel or spool, threaded through curved goose neck assembly 211 and inserted through injector head assembly 212 mounted on substantially planar support surface 53. Flexible continuous tubing 210 extends through slip bowl 54, and is concentrically received within riser 204, subsea wellhead 200 and well 202. Said flexible continuous tubing 210 can be manipulated within well 202, or otherwise beneficially used to perform work within such well 202.

Sensors within monitoring control system 70 measure inner compensating frame assembly tension, speed, position, as well as other relevant parameters. Data obtained from such sensors are supplied to at least one processor that controls the amount, direction and pressure of hydraulic fluid supplied from a hydraulic power unit to hydraulic cylinder(s) 60 (or winch drum or other lifting assembly) via hydraulic supply line 71 in order to adjust the position of inner compensating frame 40 relative to outer frame assembly 20.

Specifically, inner compensator frame assembly 40 is capable of dynamically stroking up or down relative to said outer frame assembly 20 depending on tidal movement and/or wave action. As such, even though the distance between slip bowl 54 and the surface of water 203 may change (from dimension "Y" in FIG. 7A to "Z+Y" in FIG. 7B) due to wave or tidal action, motion compensator apparatus 100 adjusts to maintain a substantially constant vertical distance (dimension "X" in FIGS. 7A and 7B) between slip bowl 54 and sea floor 201.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed:

1. A method for motion compensation while conducting intervention operations on a subsea installation from a floating vessel comprising:

a. mounting a motion compensation apparatus on said floating vessel, wherein said motion compensation apparatus comprises:

i. a first support frame having an opening;

ii. a second support frame disposed within said opening of said first frame;

iii. at least one lifting cylinder having a first end and a second end, wherein the first end of said at least one lifting cylinder is connected to said first support frame, said second end of said at least one lifting cylinder is connected to said second support frame; and iv. a monitoring control assembly comprising:

aa. at least one electronic sensor adapted to measure support frame tension, speed or position data; and bb. at least one processor;

b. running an intervention means from said floating vessel through said motion compensation apparatus to said subsea installation; and c. controlling said at least one lifting cylinder based on data measured by said at least one electronic sensor to adjust the vertical position of said second support frame relative to said first support frame to maintain a substantially constant vertical distance between said second support frame and said subsea installation.

2. The method of claim 1, wherein said intervention means comprises continuous tubing.

3. The method of claim 1, wherein said intervention means comprises electric line.

4. The method of claim 1, wherein said intervention means comprises slickline.

* * * * *